US005730078A

United States Patent [19]

Rummell et al.

[11] Patent Number: 5,730,078

[45] Date of Patent: Mar. 24, 1998

[54] POWER ATTACHMENT FOR A BOOM FOR WATER SPORTS

[76] Inventors: David L. Rummell, 208 Del Rosa Way, San Mateo, Calif. 94403; Jay O'Dea, 1261 Hiller St., Belmont, Calif. 94002

[21] Appl. No.: 584,166

[22] Filed: Jan. 11, 1996

[51] Int. Cl.[6] ..... B63B 21/04

[52] U.S. Cl. ..... 114/253

[58] Field of Search ..... 212/348, 349; 114/242, 250, 253; 441/65, 68

[56] References Cited

U.S. PATENT DOCUMENTS 4,094,230 6/1978 Wright et al. ..... 212/349

4,738,414 4/1988 McCulloh ..... 114/253

5,000,109 3/1991 Anderson .

5,241,921 9/1993 Sadlak .

*Primary Examiner*—Edwin L. Swinehart

*Attorney, Agent, or Firm*—James E. Eakin

[57] ABSTRACT

A powered boom assembly for water skiing, particularly for barefoot skiing, allows boat personnel to activate a switch to automatically change the position of the boom while the boat is operating and while the skier is using the boom. The assembly includes a powered linear actuator which is attached by a bracket to the pylon of the motor boat. A fitting on the actuator is used to mount the boom, the fitting may also be attached to the pylon, so that the fitting and boom move up and down when the actuator is activated by the switch. A bracket securely attaches the actuator to the boom.

7 Claims, 4 Drawing Sheets

POWER ATTACHMENT FOR A BOOM FOR WATER SPORTS

FIELD OF THE INVENTION

The present invention relates to booms for water sports. More specifically, the invention relates to an attachment for a boom to enable powered boom height adjustments for barefoot skiing and other water sports.

BACKGROUND OF THE INVENTION

Booms for water sports such as water skiing are known in the prior art. A barefoot water skiing boom generally is attached to a cylindrical pylon extending upward from the bottom of the center of the boat. The boom is positioned across the side, or gunnel, of the boat to extend laterally over the water so that the barefoot skier can grasp the boom and be pulled through the water along the side of the boat. A boom for water skiing is shown in U.S. Pat. No. 5,241,921. Cables generally are used to stabilize the position of the boom.

The above described booms must be securely fastened to the pylon to ensure the safety of the skier and those within the boat, and clamps generally are used to secure the boom to the pylon. A pylon clamp is shown in U.S. Pat. No. 5,000,109 and includes a first portion for connecting to the cylindrical pylon and a second portion for connection of the boom.

A number of drawbacks and limitations result when using prior art booms for barefoot water skiing. Barefoot skiers generally perform a number of maneuvers or "tricks" while skiing and it is desirable to adjust the position, particularly the height, of the boom to perform certain of those "tricks". Additionally, it is desirable to be able to adjust the height of water skiing instructional devices for different students. Adjustment of the position of the boom while barefoot waterskiing is underway presently cannot be accomplished with the prior art devices described above. Such adjustments cannot be performed unless the boat has come to a halt thereby requiring that the skier stop skiing. Adjustments presently require loosening and repositioning of the clamp on the pylon.

A heretofore unmet need exist in the industry for a boom for water skiing that can easily be adjusted by the operator of the boat while water skiing is in progress.

SUMMARY OF THE INVENTION WITH OBJECTS

A power attachment for a boom for water sports includes a powered actuator for attachment to the pylon of a boat. The actuator may be powered in a suitable manner, for example, motorized, pneumatic or hydraulic. The powered actuator is attached to the pylon using a bracket. A second fitting, preferably including any clevis type connector extending from the actuator, is used to secure the boom to the powered actuator. The second fitting preferably also is attached to the pylon. The boom extends from the second fitting laterally over the water and rests on the gunnel of the boat. A switch is provided to activate the actuator for automatically raising or lowering the second fitting with the boom attached thereto to adjust the position of the boom relative to the wishes of the skier. The power attachment allows adjustment of the position of the boom from the boat while the skier is skiing.

A general object of the invention is to provide a boom for water sports that overcomes the drawbacks and limitations of the prior art.

A specific object of the invention is to provide a power attachment for a boom for water sports, particularly for barefoot skiing.

Another specific object of the invention is to provide an actuator for attachment to the pylon of a boat and for attachment of a boom thereto.

One more specific object of the invention is to provide a motorized actuator attached to the pylon of a boat by a bracket and further having the clevis of the actuator modified to allow attachment to the pylon and to allow attachment of the boom to the modified fitting.

Yet one additional object of the invention is to provide an inexpensive, easy to install power attachment for a conventional boom and pylon that allows adjustments of the boom position while water skiing is underway.

Still another object of the invention is to provide a motorized, pneumatic or hydraulic actuator for attachment to a pylon of a boat and for engagement of a laterally extending boom.

These and other objects, advantages and features of the present invention will become more apparent upon considering the following detailed description of preferred embodiments, presented in conjunction with the accompanying drawings.

DESCRIPTION OF PREFERRED EMBODIMENTS

Figure 1:
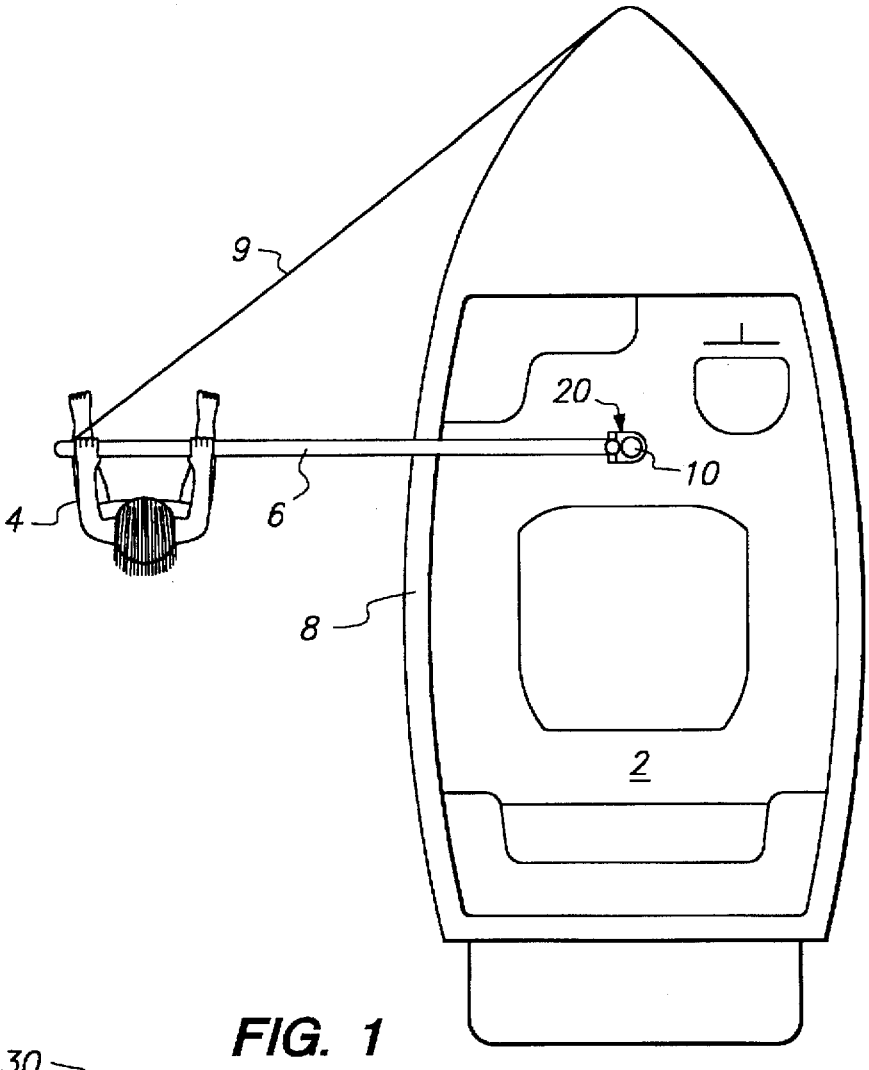
FIG. 1 is an overhead environmental view of a powered attachment for a boom for water sports shown attached to a pylon of a boat beating a barefoot water skier.

A power attachment for a boom for water sports is shown generally as reference number 20 in FIG. 1. The power attachment 20 is attached to a conventional pylon 10 extending vertically from the center of a motor boat 2. A barefoot skier 4 is grasping one end of a boom 6 which extends laterally from the power attachment 20 while the skier 4 is being pulled through the water by the boat 2. The boom 6 rests upon the boat gunnel 8 and preferably is further secured to prevent recoil and backward extension by at least one cable 9 extending from the end of the boom 6 to the bow of the boat 2. The boom 6 and pylon 10 are convention in design and are not described further.

A barefoot skier and motor boat are shown for example only and it will be recognized by those skilled in the art that the power attachment 20 may be used in any activity requiring an adjustable boom extending from a boat.

Figure 4:
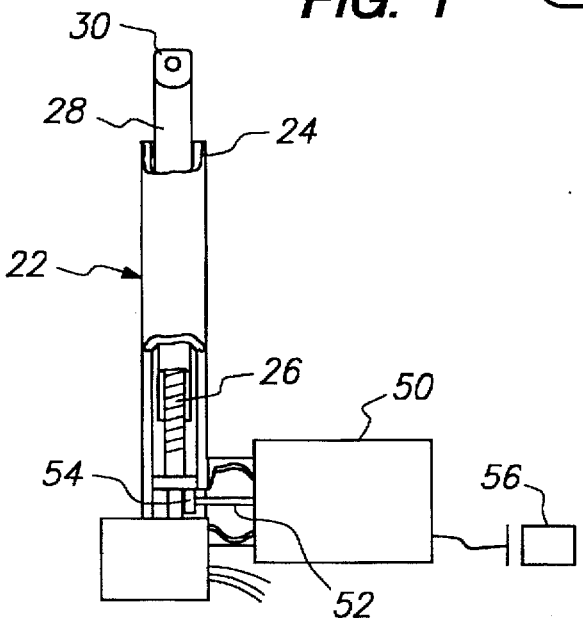
FIG. 4 is a partially cut away view of a conventional motorized actuator.
Figure 2:
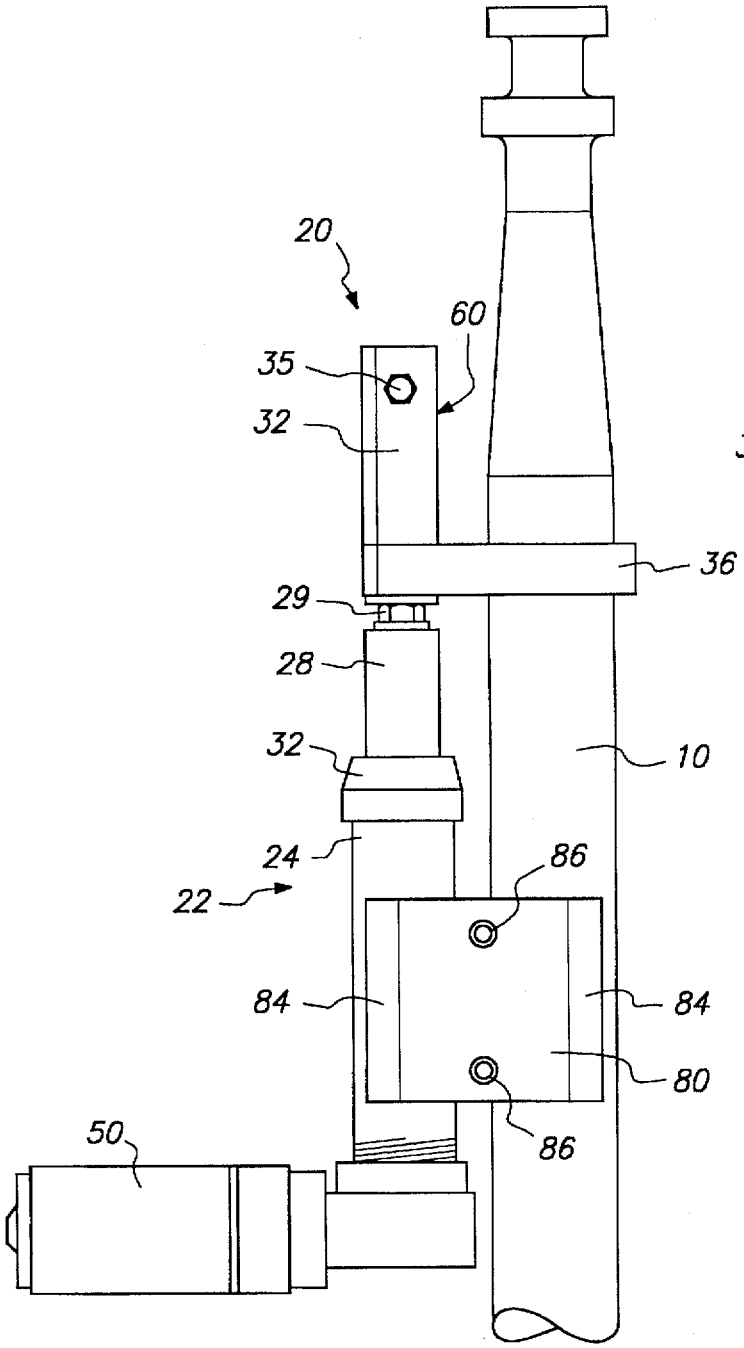
FIG. 2 is a side view of the powered attachment of FIG. 1 shown attached to the pylon.
Figure 3:
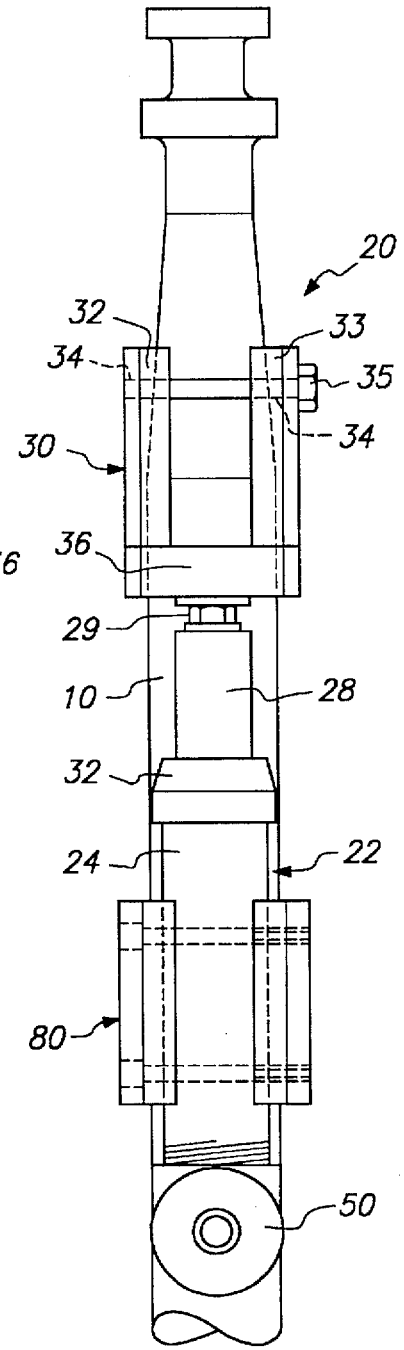
FIG. 3 is a front view of the powered attachment of FIG. 1 shown attached to the pylon.

Referring now to FIGS. 2–4, the power attachment 20 includes an actuator, for example, a Duff-Norton electro-mechanical actuator 22, which may be operated by attachment to a conventional motor or to a pneumatic or hydraulic operating system. The actuator 22 is electro-mechanical and includes an outer tube 24 housing a screw 26 for reciprocation of a translating tube 28 fitted with a nut 29. The actuator 22 defines a conventional clevis 30 for attachment of any apparatus to reciprocate with the translating tube 28.

Figure 5:
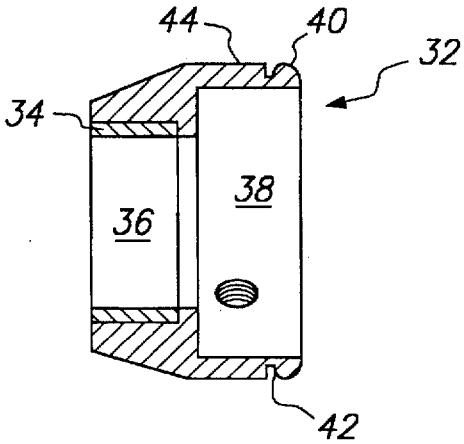
FIG. 5 is a cross sectional view of an actuator cap for support of the actuator shaft.

Referring now also to FIG. 5, a modified actuator cap 32 is provided to fit over the outer tube 24 and securely around the translating tube 28 to provide additional support to the translating tube 28 when extended, and to ensure that the actuator is sealed to prevent entry of water. The actuator cap includes an inner Teflon ring 34 around the translating tube bore 36. The Teflon ring 34 is precisely dimensioned to fit snugly around the translating tube 28 while allowing reciprocation without entry of water. The actuator cap 32 further defines an outer tube bore 38 and a rounded flange 40 to form a seal between the actuator cap 32 and the outer tube 24. A decorative slot 42 may or may not be provided above the rounded flange 40. A set screw 44 is used to secure the cap 32 to the outer tube 24.

The actuator 22 is attached to a motor 50, for example a Duff-Norton 115 Volt A.C. or 12 Volt D.C. motor. A rotatable shaft 52 extends from the motor 50, and a conventional pinion 54 is attached to the shaft 52. The pinion 54 engages the actuator 22 in a manner well known in the art to cause reciprocation of the translating tube 24 when the motor 50 is operating. A switch 56 is electrically attached to the motor 50 and may be positioned on the power attachment 20 or in the cockpit of the boat 2 for ease of access by the driver of the boat 2.

Figure 11A:
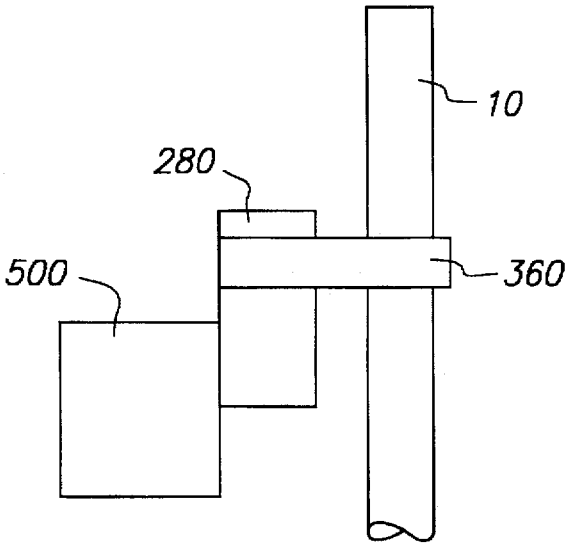
FIG. 11A is a partial block diagram of a hydraulic ram attachment shown attached to a pylon.
Figure 11B:
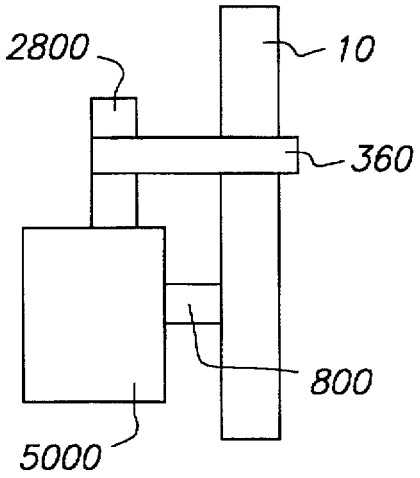
FIG. 11B is a partial block diagram of a pneumatic actuator attachment shown attached to a pylon.

The motor 50 is presented as an example only, and it will be recognized by those skilled in the art that the actuator may be operated using a pneumatic or hydraulic device, such as a Mercruiser hydraulic ram 500 or a pneumatic device 5000 as shown, respectively, in FIGS. 11A and 11B. The hydraulic ram 500 and the pneumatic device 5000 both include actuators 280 and 2800 and one or two brackets (360, 800) for attachment to the pylon 10.

Figure 6:
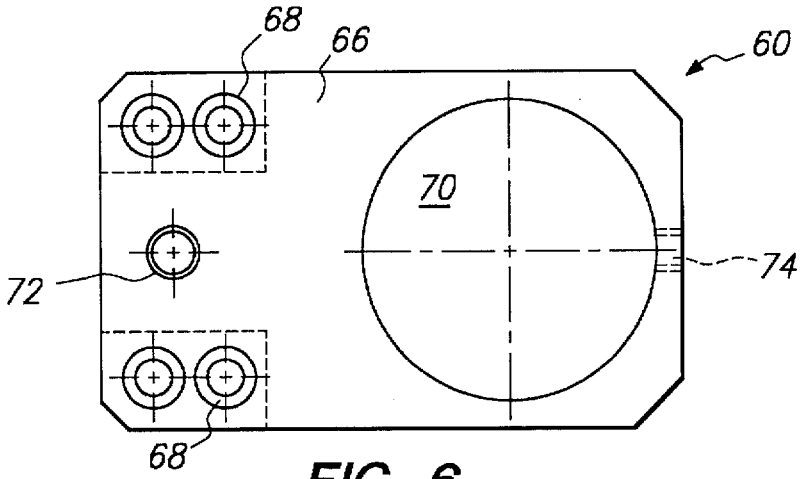
FIG. 6 is a bottom view of the fitting showing the attachment holes for connection of the actuator clevis and showing the aperture for connection of the fitting to the pylon.
Figure 7:
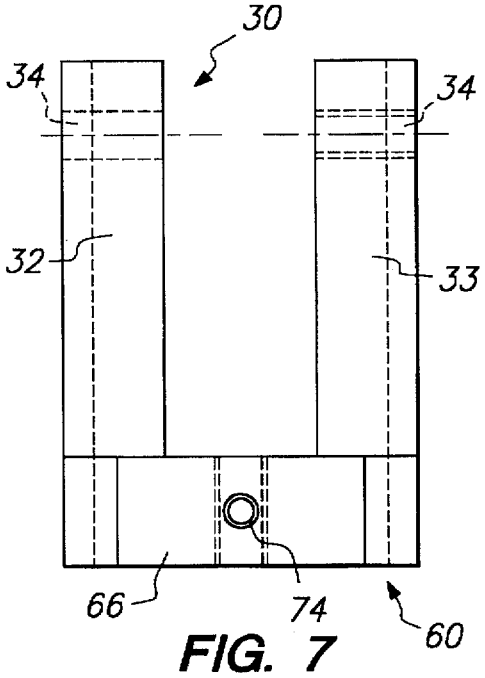
FIG. 7 is an end view of the fitting.
Figure 8:
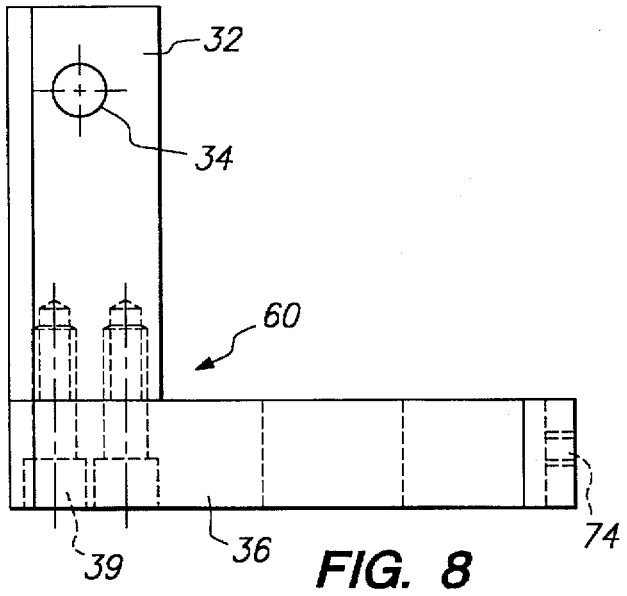
FIG. 8 is a side view of the fitting.
Figure 9:
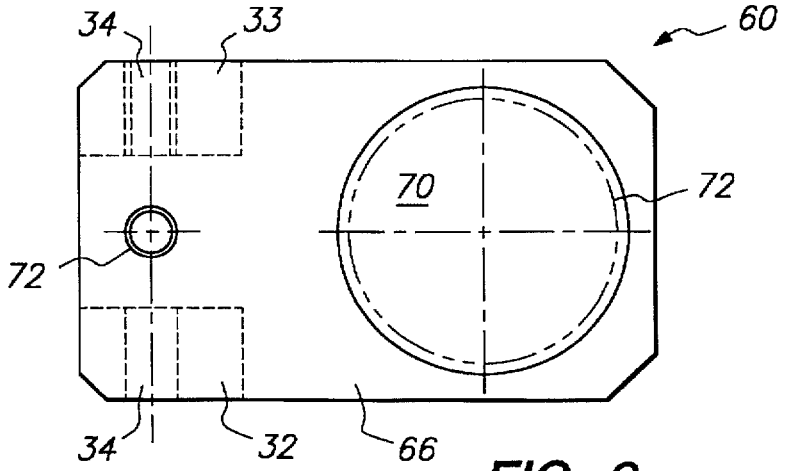
FIG. 9 is a top view of the fitting.

Referring now to FIGS. 6–9, the power attachment further includes a fitting 60 for attachment of the boom 6. Preferably, the selected actuator will include a clevis 30, as in the Duff-Norton actuator 22. The clevis 30 defines parallel spaced apart arms 32, 33 defining apertures 34 for attachment therethrough of a bolt 35 which passes through a mating aperture in the boom 6 when placed between the spaced apart arms 32, 33. The fitting 60 is formed by attaching a plate 66 to the bottom of the clevis 30. The plate 66 defines four bolt holes 68, and mating holes are drilled upwardly through the bottom of the clevis arms 32, 33 for attachment of bolts 69, as best shown in FIGS. 6, 8. The plate 66 preferable further defines an aperture 70 sized to fit over the pylon 10. For a conventional pylon typically used in water sports, the aperture 70 is approximately 2.525 inches in diameter and the pylon is approximately 2.5 inches in diameter. The aperture 70 includes a Teflon gasket 72 to facilitate sliding of the fitting 60 up and down the pylon 10. An actuator aperture 73 also is provided through the bottom of the plate 66 to ensure that the actuator 22 and fitting 66 are securely engaged during reciprocation of the translating tube 24. A set screw 74 also is provided for engagement of the plate 66 to the pylon 10.

Attachment of the fitting 60 to an upper region of the pylon 10 correct for torque produced during use the boom thereby stabilizing the powered attachment 20 on the pylon. If desired, the fitting 60 may be eliminated thereby simply attaching the boom 6 to the conventional clevis 30 on the selected actuator. It is highly recommended that, in such an embodiment, the actuator be strapped to the pylon 10 to prevent twisting of the attachment 20 because of torque produced at the boom 6.

Figure 10:
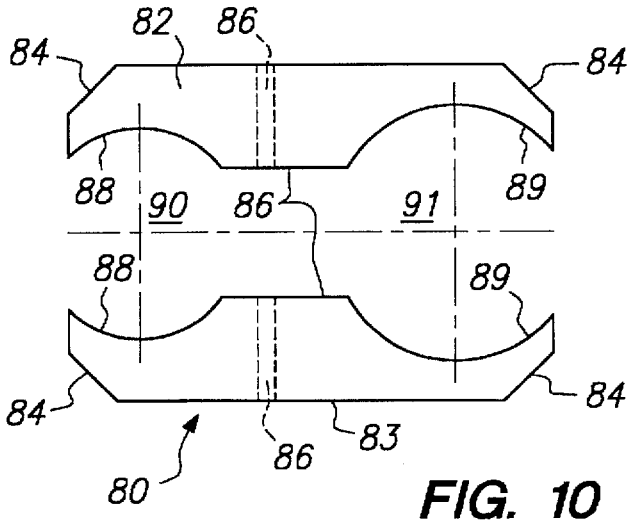
FIG. 10 is a top view of the bracket for securing the powered attachment to the pylon.

Referring now to FIGS. 1, 2 and 10, a bracket 80 also is provided at a lower region of the pylon 10 to secure the power attachment 20 to the pylon 10. The bracket 80 defines opposed sides 82, 83 defining beveled comers 84 and connected together by bolts 86 extending through one opposed side and into and through the other opposed side. Alternatively, the bracket may be of unitary construction using a generally central bridge connecting portion (not shown). Connecting the sides 82, 83 with bolts is preferred for ease of attachment of the power attachment 20 to the pylon 10 and to allow tightening to firmly connect the attachment 20 to the pylon 10. The inner face 86 of each side 82, 83 is contoured in two places 88, 89 to form half of a cylinder. When positioned around the power attachment 20 and the pylon 10, cylindrical openings 90, 91 are formed for, respectively, the power attachment 20 and the pylon 10.

The bracket 80 and the fitting 60 both are fabricated preferably from aluminum, although other suitable, strong, non-corrosive metals and materials may be used. If desired, the power attachment 20 may be configured so that the actuator activates two booms thereby allowing booms to extend from both sides of the boat. Such a configuration may utilize two actuator assemblies or a single relatively powerful actuator configured to simultaneously raise or lower both booms.

While this invention has been described in connection with preferred embodiments thereof, it is obvious that modifications and changes therein may be made by those skilled in the art to which it pertains without departing from the spirit and scope of the invention. For instance, any linear actuator may be used, including other motor arrangements and configurations, or pneumatic or hydraulic systems may be employed. Accordingly, the bracket described herein, and the fitting including the clevis of the actuator, may be modified to accommodate other actuator shapes and sizes. Additionally, the fitting may be of unitary construction including a clevis if desired, particularly when the selected actuator does not include a clevis or replacement of the existing clevis is elected without departing from the spirit and scope of the invention. Accordingly, the aspects discussed herein are for illustration only and should not limit the scope of the invention herein which is defined by the claims.

What is claimed is:

1. A power attachment for use with a boom and for use with a pylon within a water sports vehicle, the power attachment comprising:

powered actuator means for moving at least one end of the boom when in use with the water sports vehicle and when the water sports vehicle is not in use so as to adjust the height of the boom;

fitting means for attaching the boom to the powered actuator means; and bracket means for operatively connecting the powered actuator means to the pylon within the water sports vehicle.

2. The power attachment of claim 1 wherein the fitting means is adapted for operative attachment to the pylon within the water sports vehicle.

3. The power attachment of claim 1 wherein the powered actuator means is a linear actuator for moving the boom upward and downward.

4. The power attachment of claim 2 wherein activation of the powered actuator means causes the fitting means to slide on the pylon.

5. The power attachment of claim 2 wherein the fitting means defines a clevis adapted for attachment of the boom and a generally cylindrical aperture for sliding engagement with the pylon.

6. The power attachment of claim 1 wherein the bracket means defines a first aperture for the actuator means and a second aperture for the pylon.

7. A power attachment for use with a boom and for use with a pylon within a water sports vehicle, the power attachment comprising:

a powered actuator for moving at least one end of the boom when in use with the water sports vehicle and when the water sports vehicle is not in use so as to adjust the height of the boom;

a fitting adapted to operatively attach the boom to the powered actuator, the fitting adapted to be operatively attached to the pylon within the water sports vehicle wherein activation of the powered actuator causes the fitting to slide on the pylon; and a bracket adapted to operatively connect the powered actuator to the pylon within the water sports vehicle.

* * * * *